US005339853A

United States Patent [19]

Sokolis et al.

[11] Patent Number: 5,339,853

[45] Date of Patent: Aug. 23, 1994

[54] WALKING ASSISTANCE NIGHT LIGHT APPARATUS

[76] Inventors: Herman G. Sokolis; Linda L. Sokolis, both of R.R. 1 Box 116B, Franklin, Ill. 62638

[21] Appl. No.: 75,608

[22] Filed: Jun. 14, 1993

[51] Int. Cl.[5] ..... A61H 3/00; A45B 3/02

[52] U.S. Cl. ..... 135/67; 135/65; 135/66; 135/910

[58] Field of Search ..... 135/910, 65, 66, 67

[56] References Cited

U.S. PATENT DOCUMENTS

| | | | |
|---|---|---|---|
| 1,574,623 | 2/1926 | Grau | 135/910 |
| 1,659,346 | 2/1928 | Beatty | 135/910 |
| 2,173,624 | 7/1938 | Dyer | 135/910 |
| 4,062,371 | 12/1977 | Bolen | 135/910 |
| 4,625,742 | 12/1986 | Phillips | 135/910 |
| 5,188,139 | 2/1993 | Garelick | 135/67 |

FOREIGN PATENT DOCUMENTS

| | | | |
|---|---|---|---|
| 2549353 | 1/1985 | France | 135/910 |
| 0216281 | 3/1942 | Switzerland | 135/910 |
| 1135930 | 12/1968 | United Kingdom | 135/910 |

*Primary Examiner*—Carl D. Friedman
*Assistant Examiner*—Wynn E. Wood
*Attorney, Agent, or Firm*—E. Michael Combs

[57] ABSTRACT

Walking assistance devices to include a cane, crutch, and walker assembly each include a support leg having a resilient engaging tip at free distal ends of each support leg, such that transparent windows directed through the support leg adjacent the tip include an illumination bulb positioned therebetween for projecting illumination from the support leg through the windows for assistance in use of the walking device.

1 Claim, 4 Drawing Sheets

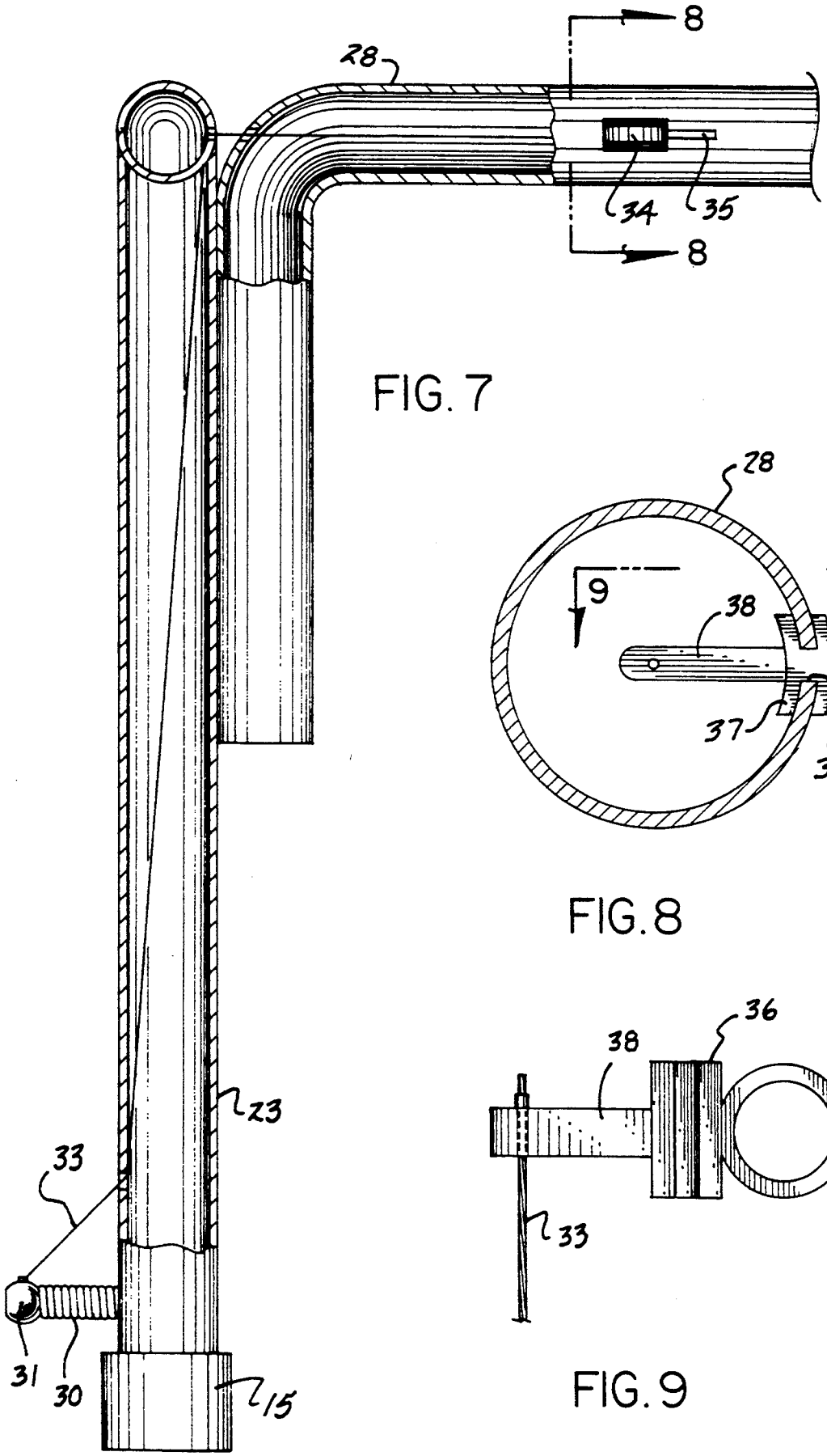
FIG. 7
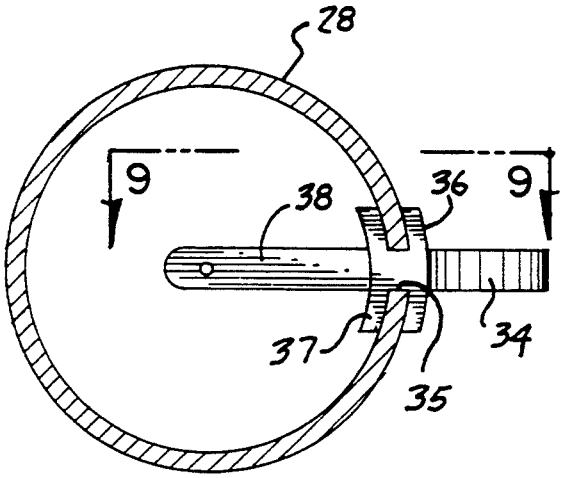
FIG. 8
FIG. 9

WALKING ASSISTANCE NIGHT LIGHT APPARATUS

BACKGROUND OF THE INVENTION

1. Field of the Invention

The field of invention relates to walking assistance structure, and more particularly pertains to a new and improved walking assistance night light apparatus wherein the same is arranged to project illumination relative to a walking assistance device in forums of limited available light.

2. Description of the Prior Art

Walking assistance structure of various types are utilized throughout the prior art, wherein the U.S. Pat. Nos. 4,837,666 and 4,099,535 indicate cane-like structure employing illumination assisting devices associated therewith.

The instant invention attempts to overcome deficiencies of the prior art by providing for a self-contained walking assistance structure wherein the support leg includes illumination windows directed through the support lee adjacent the support leg lowermost distal end at the resilient engaging tip to project illumination along a support surface in use and in this respect, the present invention substantially fulfills this need.

SUMMARY OF THE INVENTION

In view of the foregoing disadvantages inherent in the known types of walking assistance structure now present in the prior art, the present invention provides a walking assistance night light apparatus wherein the same is arranged to project illumination relative to a walking assistance device at its lowermost end. As such, the general purpose of the present invention, which will be described subsequently in greater detail, is to provide a new and improved walking assistance night light apparatus which has all the advantages of the prior art walking assistance structure and none of the disadvantages.

To attain this, the present invention provides walking assistance devices to include a cane, crutch, and walker assembly, each including a support leg having a resilient engaging tip at free distal ends of each support leg, such that transparent windows directed through the support leg adjacent the tip include an illumination bulb positioned therebetween for projecting illumination from the support leg through the windows for assistance in use of the walking device.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved walking assistance night light apparatus which has all the advantages of the prior art walking assistance structure and none of the disadvantages.

It is another object of the present invention to provide a new and improved walking assistance night light apparatus which may be easily and efficiently manufactured and marketed.

It is a further object of the present invention to provide a new and improved walking assistance night light apparatus which is of a durable and reliable construction.

An even further object of the present invention is to provide a new and improved walking assistance night light apparatus which is susceptible of a low cost of manufacture with regard to both materials and labor, and which accordingly is then susceptible of low prices of sale to the consuming public, thereby making such walking assistance night light apparatus economically available to the buying public.

Still yet another object of the present invention is to provide a new and improved walking assistance night light apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 7 is an orthographic view, partially in section, of section 7 as set forth in FIG. 5.

FIG. 8 is an orthographic view, taken along the lines 8—8 of FIG. 7 in the direction indicated by the arrows.

FIG. 9 is an orthographic view, taken along the lines 9—9 of FIG. 8 in the direction indicated by the arrows.

DESCRIPTION OF THE PREFERRED EMBODIMENT

Figure 1:
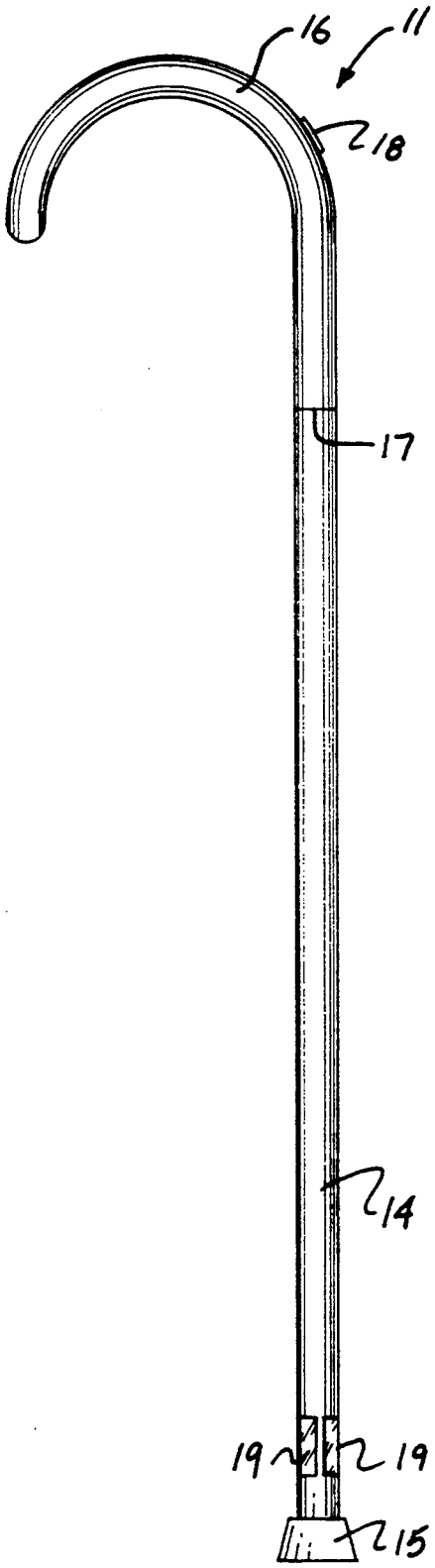
FIG. 1 is an orthographic view of a cane structure for use by the invention.
Figure 2:
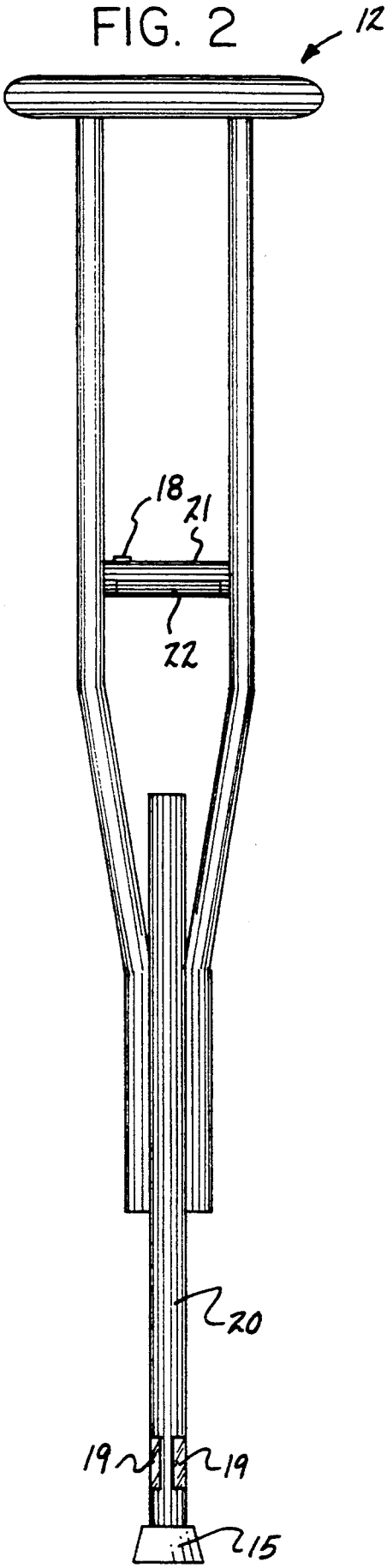
FIG. 2 is an orthographic view of a crutch structure for use by the invention.

With reference now to the drawings, and in particular to FIGS. 1 to 9 thereof, a new and improved walking assistance night light apparatus embodying the principles and concepts of the present invention and generally designated by the reference numerals 11–38 will be described.

Figure 3:
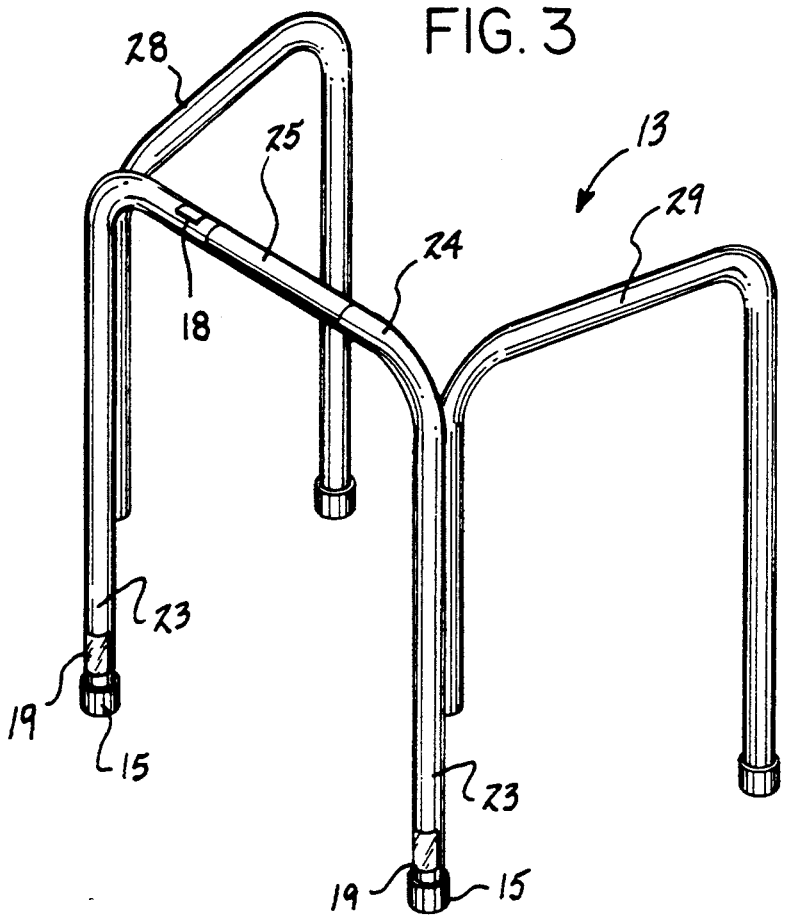
FIG. 3 is an isometric illustration of a walker assembly.

More specifically, the walking assistance night light apparatus of the instant invention essentially comprises the use of illumination mounted at a lowermost end of a respective support leg of a cane 11 (see FIG. 1), a crutch member 12 (see FIG. 2), or a walker assembly 13 (see FIG. 3).

Figure 4:
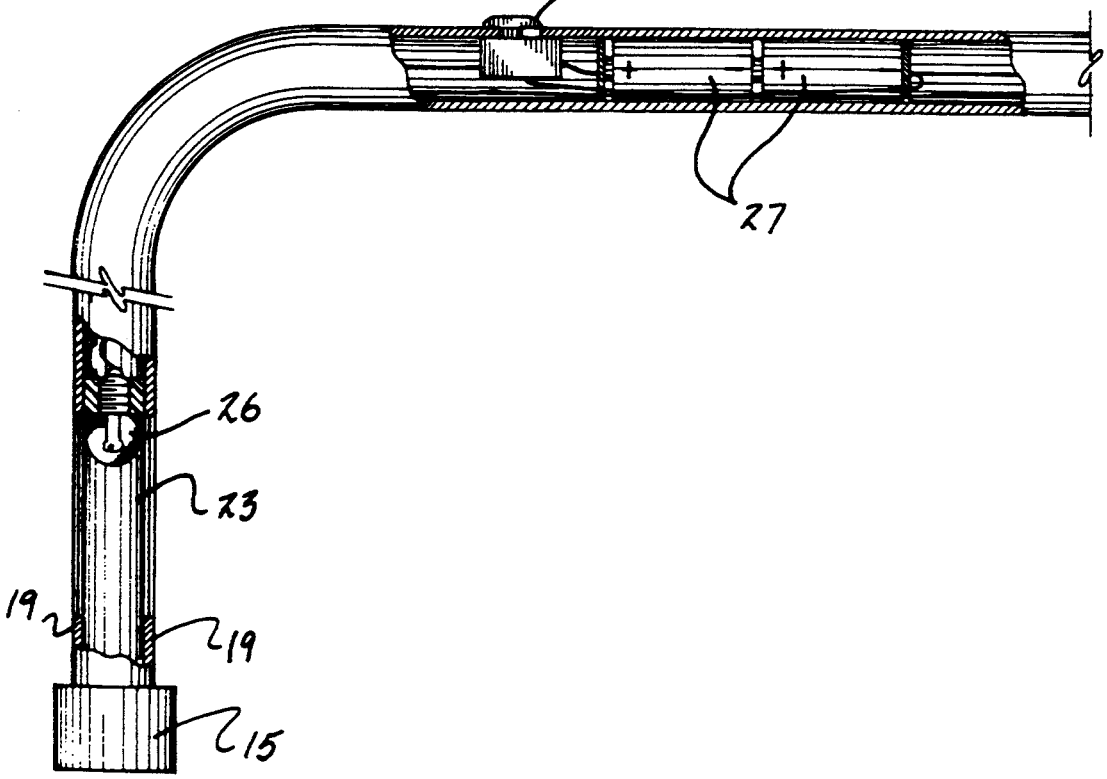
FIG. 4 is a partial orthographic view, partially in cross-section, indicating the association of the switch and illumination bulb structure relative to transparent windows.

The cane 11 includes a cane support leg 14 having a resilient engaging tip 15, with a cane handle 16 removably mounted relative to the cane support leg 14 at a central connection 17 arranged for access to the cane handle 16 typically containing batteries, as well as a switch 18 for actuation of illumination bulb of a type as indicated in FIG. 4 for example, positioned in adjacency to spaced transparent windows 19 that are typically diametrically mounted relative to one another in adjacency to the engaging tip 15. The crutch 12 in a similar manner employs a crutch support leg 20, having the resilient engaging tip 19 at its lowermost distal end, with spaced transparent windows 19. The crutch handle 21 is spaced from the crutch support leg 20, including a handle door 22 for access to batteries positioned within the crutch handle cooperative with the switch 18.

The walker assembly 13 employs a forward U-shaped frame having walker support legs 23 parallel and spaced relative to one another interconnected by a walker handle tube 24, including a walker handle door 25 accessing the batteries 27 for directing electrical communication between the switch 18 and the illumination bulb 26 positioned in adjacency to the transparent windows 19, as indicated in FIG. 4, that in turn is positioned and directed towards the resilient tip 15 of each of the walker support legs 23. First and second U-shaped frames 28 and 29 mounted to opposed walker support legs 23 are splayed relative to one another providing for the assembly, wherein each of the first and second U-shaped frames 28 and 29 include respective first and second U-shaped frame legs that are parallel relative to one another and to the walker support legs 23.

Figure 5:
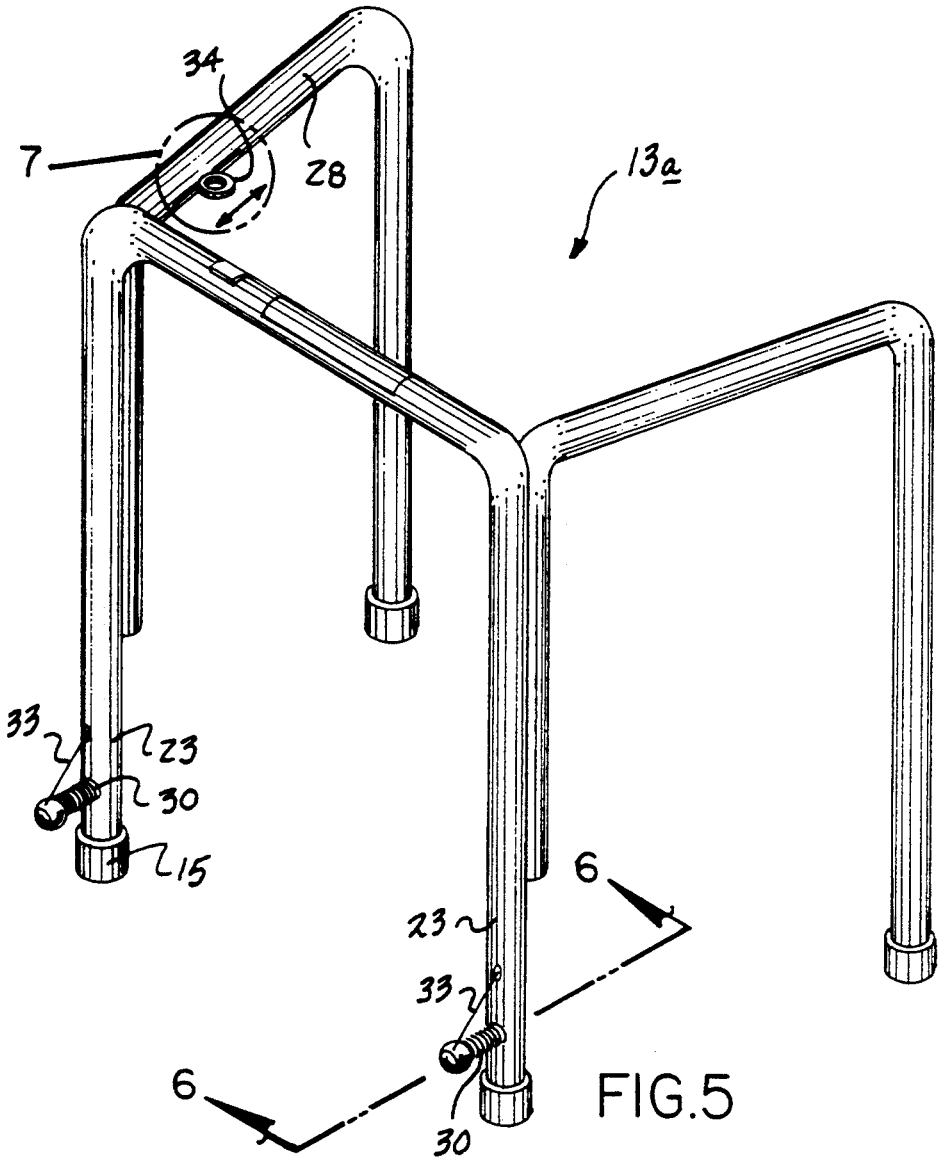
FIG. 5 is an isometric illustration of a modified walking assistance structure.
Figure 6:
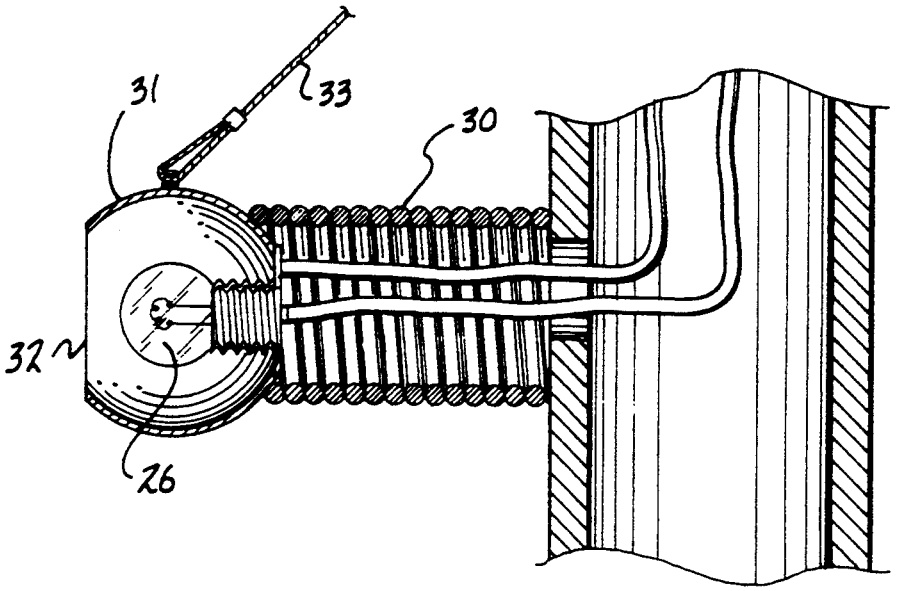
FIG. 6 is an orthographic view, taken along the lines 6—6 of FIG. 5 in the direction indicated by the arrows.

A modified walker assembly 13*a* is indicated in FIG. 5, wherein in lieu of the windows 19, an individual illumination bulb 26 (see FIG. 6) is mounted within a spherical reflector housing 31 that in turn is mounted to an outermost distal end of a coil spring mount 30 that projects from an individual one of the walker support legs 23. A pull cable 33 is provided, having its first end secured to the reflector housing 31 and its second end directed through an individual walker support leg 23, with a second end of each cable 33 secured to a pull ring 34, of a type as illustrated in the FIGS. 5 and 6, mounted to an individual one of the U-shaped support frames 28 and 29. For purposes of illustration, the pull ring of the first U-shaped frame is illustrated, but it is understood that the construction is identical and of a mirror image orientation relative to the second U-shaped support frame 29.

The pull ring 34 is slidably received within a receiving slot 35 within a U-shaped support frame 28, with the receiving slot 35 slidably guiding respective first and second U-shaped guide tracks 36 and 37 (see FIG. 5) that are integrally mounted to the pull ring 34. A connecting leg 38 projects into the support frame tube, as indicated in FIG. 8, receiving and securing the second end of the pull cable 33 thereto. In this manner, upon displacing of the pull fine 34 relative to the slot 35, tension is applied to the pull cable 33 to provide for pivotal deflection of the reflector housing and accordingly to permit reorientation of illumination directed from the reflector housing 31, and more specifically from the reflector housing opening 32.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A walking assistance night light apparatus comprising:

a first and second support leg having a handle defining a primary U-shaped frame, said support legs including a lowermost distal end spaced from said handle wherein said lowermost distal end includes a resilient tip secured thereto, illumination means mounted to said support legs in adjacency to said resilient tip, a first U-shaped support frame mounted to said first support leg and a second U-shaped support frame mounted to said second support leg wherein the first and second U-shaped support frames are arranged in a sprayed orientation relative to one another, the illumination means including an illumination bulb and a coil spring mount mounted to said support legs, said coil spring mount each including a spherical reflector housing, said spherical reflector housing including an opening, said illumination bulb being mounted within said spherical reflector housing, said apparatus further including a pull cable, the pull cable having a first and a second end; the first end being secured to said spherical reflector housing with the pull cable being directed through the primary U-shaped frame, the first U-shaped support frame having a receiving slot, said apparatus further including a pull ring, the pull ring including a first U-shaped guide track and a second U-shaped guide track received within said receiving slot oriented for sliding along said receiving slot, wherein the pull ring includes a connecting leg extending into said first U-shaped support frame, the pull cable second end being secured to said connecting leg whereupon displacement of said pull ring within said receiving slot effects displacement of said spherical reflector housing relative to said coil spring mount.

* * * * *